United States Patent [19]

Offermann

[11] Patent Number: 4,571,487

[45] Date of Patent: Feb. 18, 1986

[54] METHODS AND APPARATUS FOR SUPPLYING ELECTRICAL POWER FOR PROXIMITY EFFECT HEAT-TRACING

[75] Inventor: Paul F. Offermann, Redwood City, Calif.

[73] Assignee: Chevron Research Company, San Francisco, Calif.

[21] Appl. No.: 537,994

[22] Filed: Sep. 30, 1983

[51] Int. Cl.[4] ..... H05B 1/02; H05B 1/00

[52] U.S. Cl. ..... 219/482; 219/301; 219/503; 361/45; 361/57; 307/17; 307/83; 323/361; 323/332; 323/262

[58] Field of Search ..... 219/300, 301, 503; 323/262, 332, 335, 361; 361/36, 45, 87, 57; 307/17, 83; 324/51, 52

[56] References Cited

U.S. PATENT DOCUMENTS

| | | | |
|---|---|---|---|
| 3,523,177 | 8/1970 | Ando | 219/300 |
| 3,524,966 | 8/1970 | Ando | 219/300 |
| 3,632,975 | 1/1972 | Ando | 219/300 |
| 3,743,795 | 7/1973 | Ousey | 307/17 |
| 3,755,650 | 8/1973 | Ando | 219/301 |
| 3,983,360 | 9/1976 | Offermann | 219/301 |
| 4,002,881 | 1/1977 | West | 219/301 |
| 4,471,231 | 9/1984 | Minami | 307/83 |

FOREIGN PATENT DOCUMENTS

| | | | |
|---|---|---|---|
| 0582596 | 11/1977 | U.S.S.R. | 219/300 |

OTHER PUBLICATIONS

"Long Pipelines are Heated by Syste" The Oil and Gas Journal, Nov. 18, 1974.

*Primary Examiner*—M. H. Paschall
*Attorney, Agent, or Firm*—Edward J. Keeling

[57] ABSTRACT

A proximity effect heat-tracing system in which proximity effect heat-tracing circuits are fed in either direction from a plurality of feed points connected to a single main transformer to increase the length of pipeline supplied by a single main transformer. A secondary transformer interposed between a main transformer and a plurality of feed points reduces the voltage required to be applied to a proximity effect heat-tracing system of a given length. Two or more proximity effect heat-tracing systems used along the same length of pipeline, employ neutral conductors having approximately the same diameter as "hot" conductors where the secondary of the main transformer in each system is 180° electrically out of phase with the secondary of the main transformer in the other system. A center-tap secondary in each subsidiary transformer is connected to a heat tube so that each proximity effect heat-tracing circuit is connected between an end of a secondary winding of a subsidiary transformer and a center tap of a secondary winding of a subsidiary transformer in order to minimize current in the transformers secondaries. Selection of the turns ratios of subsidiary transformer remote from the main transformer compensates for the voltage drop along a transmission line connecting the main transformer with subsidiary transformers.

17 Claims, 5 Drawing Figures

10
11
12
13
14
14a
14b
14c
15
16
17
18
19
20
22
24
25
26
28
30
32
34
36
40
L
L/2
L/4
0

METHODS AND APPARATUS FOR SUPPLYING ELECTRICAL POWER FOR PROXIMITY EFFECT HEAT-TRACING

BACKGROUND OF THE INVENTION

The present invention pertains in general to methods and apparatus for heat-tracing and in particular to methods and apparatus for supplying electrical power to proximity effect heat-tracing systems.

Viscous fluids, particularly heavy oil and molten sulfur, are often most conveniently transported by pipelines. Movement of viscous fluids through such pipelines is facilitated by maintaining the fluids at an elevated temperature.

Steam- or electrically-heated tracer pipes are commonly welded to pipelines in order to maintain the pipelines at temperatures above the ambient temperature. However, it is generally costly to provide steam or conventional electrical resistance heating in tracing pipes for the length of a long-distance pipeline. This cost is due, in part, to the need for energy input points at intervals of a few hundred to a few thousand feet.

One type of electrical heating used in long-distance pipelines is proximity effect heating, proximity effect heating is a form of impedance heating in which an insulated conductor passes through the interior of a ferromagnetic pipe called a heat tube. An alternating current power source is connected between a first end of the heat tube and a first end of the conductor, while a second end of the heat tube is connected to a second end of the conductor. Current flows from the power source through the conductor to the second end of the conductor and returns through the heat tube. Heat is generated by the $I^2R$ loss of the return current flow, by hysteresis and eddy currents induced within the heat tube wall by the alternating magnetic field around the insulated conductor, and by the $I^2R$ loss in the insulated conductor.

By a process of electromagnetic induction, the current in the insulated conductor causes the return current to concentrate at the inner surface of the heat tube which is the surface of the tube nearest the conductor. This phenomenon of current concentration is properly referred to as the proximity effect, although the term "skin effect" is often applied.

One advantage of proximity effect heat-tracing systems is that energy inputs may be spaced up to several miles apart. However, the voltage required to energize a proximity effect circuit is directly proportional to the length of the circuit so that conventional proximity effect circuits having energy inputs spaced at intervals of several miles require input voltages in the order of several kilovolts to cause a sufficiently large flow of current in the insulated conductor. Insulated cable for use at these voltage levels has been cited, in U.S. Pat. No. 3,524,966, as costing up to 50% of the installation cost of a heat generating pipe.

An approach to supplying additional lengths of proximity effect circuit is shown in U.S. Pat. No. 3,523,177, wherein a secondary side of a first transformer serving as a power source to a first length of circuit feeds electricity to a primary side of a second transformer in series. The second transformer serves as a power source to a second length of circuit. Additional lengths of circuit are supplied by adding further transformer in series. A major disadvantage of this approach is that all lengths of the heating circuit are in series so that the energy input to each cannot be made and broken independently in order to compensate for a broken wire in a section or to regulate heating on a section-by-section basis.

An approach to reducing electrical insulation costs is disclosed in U.S. Pat. No. 3,524,966, wherein advantage is taken of the fact that the difference in electrical potential between the insulated conductor and the heat tube declines gradually to zero from the first end to the second end. By lowering the grade of insulation in a stepwise fashion from the first to the second end, a major reduction in cost is obtained. Although use of this approach reduces the insulation cost of operating under a given applied voltage, it does not allow the flexibility to choose to lower the voltage to be applied or to extend the length of circuit supported by a given applied voltage.

As a practical matter in existing circuits, the length of a proximity effect circuit is limited by the voltage that can be applied and the voltage that can be applied is limited by the voltage rating of the insulation around the cable used as the conductor within the heat tube. Consequently, it is highly desirable to substantially reduce the voltage required for a given length of proximity effect circuit or to substantially increase in the length of proximity effect circuit which can be energized by a given voltage.

SUMMARY OF THE INVENTION

Accordingly, it is an object of the present invention to provide a new and improved apparatus for supplying electrical power from a power source to proximity effect heat-tracing circuits.

It is the further object of the present invention to provide a method for supplying electrical power from a power source to proximity effect heat-tracing circuits.

Yet another object of the present invention is to provide a method for reducing the amount of voltage applied to in-place proximity effect heat-tracing circuits having at least one main transformer coupled to a power source.

Among the advantages of the present invention is that the present invention allows the length of pipeline heated by a single, main proximity effect next tracing station therefore circuits to be doubled for a particular applied voltage. Alternatively, the present invention allows the voltage required to be applied to proximity effect heat-tracing circuit to be reduced by half, tending the same heat input to the same length of pipeline.

These and other objects and advantages of the present invention will become apparent to those skilled in the art upon consideration of the accompanying specification, claims and drawings.

In order to attain the above-mentioned and other objects and advantages, the apparatus of the present invention involves supplying electrical power from a power source to proximity effect heat-tracing circuits. The apparatus according to the present invention includes a main station comprising a first main step-down transformer having a primary winding coupled to the power source. A plurality of subsidiary stations are coupled to the main station as a common current source. Each energy feed point is coupled to at least one proximity effect heat-tracing circuit.

A method for practicing the present invention involves supplying electrical power from a power source to proximity effect heat-tracing circuits and comprises the steps of coupling a primary winding of a first main stepdown transformer to the power source and coupling a plurality of secondary windings of the first main stepdown transformer to a plurality of energy feed points in a common current source relationship. Each of the energy feed points is coupled to at least one proximity effect heat-tracing circuit.

Another method for practicing the present invention involves reducing the amount of voltage applied to in-place proximity effect heat-tracing system having at least one main transformer coupled to a power source and at least one first proximity effect heat-tracing circuit coupled to the main transformer. The method includes coupling a plurality of second proximity effect heat-tracing circuits in a common current source relationship with each other replacing the first proximity effect heat-tracing circuit, and coupling the first and second proximity effect heat-tracing circuits to the main transformer as a common current source.

DESCRIPTION OF THE PREFERRED EMBODIMENTS

If a proximity effect heat-tracing circuit is run in each direction from a feed point, the length L of pipeline that can be heated from a single feed point is twice the length of a single proximity effect heat-tracing circuit. Conventionally, on long pipelines, proximity effect heat-tracing stations are located along the pipeline at a distance L apart, with the end stations located at a distance L/2 from the ends of the pipeline. A feed point is located at each station, and the proximity effect heat-tracing circuit is run in each direction for a distance L/2 from each station. Each circuit is supplied with single-phase alternating current power from a Scott T transformer bank which converts 3-phase power to 2-phase power. (Two single-phase circuits electrically 90° apart in phase relationship, one of which supplies each of the proximity effect heat-tracing circuits.) The 3-phase power, normally at a transmission voltage substantially higher than the proximity effect circuit voltage, may be supplied from a power line carried on poles along the pipeline right of way. Necessary switchgear, relays and control equipment are part of each proximity effect heat-tracing station.

According to the present invention, instead of feeding two proximity effect circuits (one in either direction) at each proximity effect heat-tracing station, the single-phase power for the proximity effect heat-tracing circuits may be carried on overhead lines, on the same poles which carry the transmission lines supplying 3-phase power to the proximity effect heat-tracing stations, to remote feed points at a distance L/2 in either direction from the proximity effect heat-tracing station. At each remote feed point, a proximity effect heat-tracing circuit is run in each direction on the pipeline for a distance of L/2. Thus, a length of pipeline L can be heated from each remote feed point, and a length of pipeline 2L can be heated from a single proximity effect heat-tracing station. This effectively doubles the length of pipeline that can be heated from a single, main proximity effect heat-tracing station.

Figures 1, 2A, 2B:
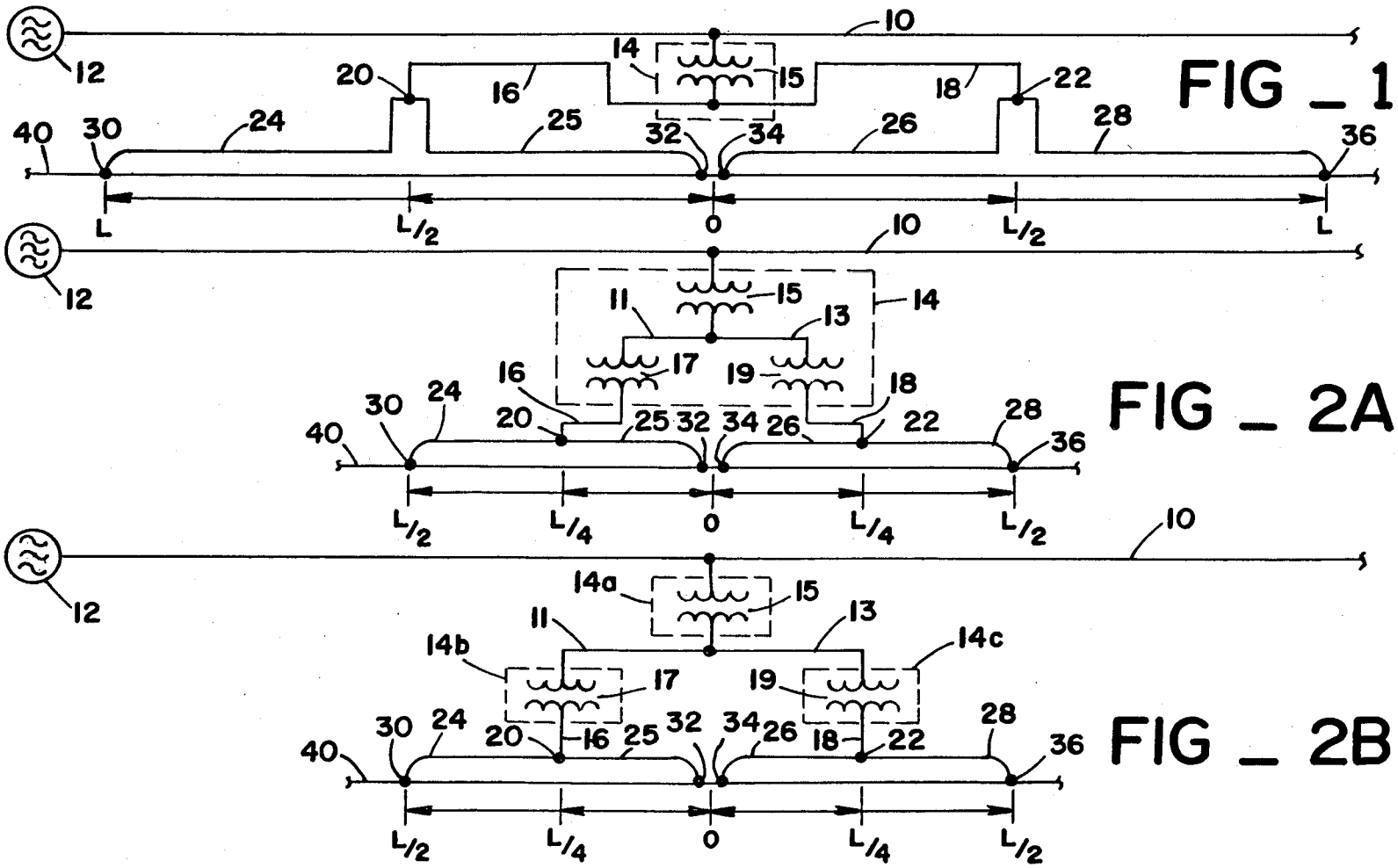
FIG. 1 is a schematic diagram of a first embodiment according to the present invention.
FIG. 2A is a schematic diagram of a second embodiment according to the present invention.
FIG. 2B is a schematic diagram of a third embodiment according to the present invention.

In FIG. 1, a first embodiment, according to the present invention, is schematically illustrated. As in all of the Figures, circuit breakers, contactors, temperature control apparatus, sensors, and other apparatus well known and readily available to those skilled in the art of proximity effect heat-tracing, have been omitted for the sake of clarity. Likewise, the pipeline to be heated by the proximity effect heat-tracing circuit is not shown. In FIGS. 1, 2A and 2B, in particular, return conductors are not shown in order to provide a broad overview of the present invention before proceeding to the more detailed diagrams of FIGS. 3 and 4.

In FIG. 1, a transmission line 10 is supplied with 3-phase alternating current from a 3-phase alternating current source 12. At a convenient point along a pipeline to be heated, a main proximity effect heat-tracing station comprising a transformer 15 is connected to transmission line 10. The 3-phase alternating current is converted to 2-phase alternating current at a main proximity effect heat-tracing location by a Scott T transformer bank 15. Transmission lines 16 and 18 are connected to station 15 so that lines 16 and 18 each carry a single-phase alternating current to each of feed points 20 and 22 to which they are respectively connected. Transformer 15 may be of the single-phase type if single-phase current is provided along transmission line 10.

As is shown in FIG. 1, feed points 20 and 22 are connected to main proximity effect heat-tracing station 15. For a single-phase transformer 15, feed points are connected in parallel while for a Scott T transformer 15, the feed points are connected to the separate phases of the two-phase output of the transformer. Either of these situations may be described as having feed points coupled in a common current source relationship because in each situation a single transforming apparatus provides current input for all feed points without any intermediary current source between the transformer and the feed points. Feed points 20 and 22 are each located at a distance L/2 from the center point, at "0" of a section of pipe line served by transformer 15.

At feed point 20, conductor 16 connects with an insulated conductor 24 and an insulated conductor 25, each of which carries a current within a heat tube toward an opposite end of heat tube 40. Conductor 24 connects with heat tube 40 at a point 30.

Feed point 22 comprises a connection between conductor 18, a conductor 26, and a conductor 28. Conductors 26 and 28 carry currents toward different ends of heat tube 40 and respectively connect at a point 34 and at a point 36 with heat tube 40.

Thus, as is clear to one skilled in the art upon consideration of FIG. 1, where the prior art would have a connection at points 32 and 34 to two insulated conductors carrying current for a distance L/2 in either direction within the heat tubes, the apparatus according to the present invention provides two remote feed points for a single proximity effect heat-tracing station which permits heating over twice the length of pipeline for the same voltage and current in each proximity effect heat-tracing circuit.

FIG. 2A is a depiction of the second embodiment of the present invention in which structures which also appear in FIG. 1 are referenced by the same numerals and in which structures which appear in FIG. 1 in a different form are referenced by the same numerals as are used in FIG. 1 with the addition of a prime to indicate a different embodiment.

In FIG. 2A, a conductor 11 is connected to transformer 15 and is connected to a first subsidiary step-down transformer 17 so that conductor 11 and transformer 17 are interposed between transformer 15 and conductor 16. A conductor 13 is connected to a second subsidiary step-down transformer 19. Transformer 19 is in turn connected to conductor 18 so that conductor 13 and transformer 19 are interposed between transformer 15 and conductor 18.

Transformers 15 are installed at a main proximity effect heat-tracing location 14. Nevertheless, it is intended that FIG. 2A depicts two subsidiary proximity effect heat-tracing stations, 17 and 19, each comprising a subsidiary step-down transformer. Thus, the term "subsidiary station" may refer to a feed point or to a subsidiary step-down transformer depending upon the requirements of a particular application.

Another difference between the embodiment of FIG. 2A and the embodiment of FIG. 1 is that feed points 20 and 22 are located at a distance L/4 and nodes 30 and 36 are located at distance L/2 from the center point of the section of pipeline served by transformer 15 because the voltage is one-half as great.

In a third embodiment according to the present invention, as illustrated in FIG. 2B, structures which also appear in FIG. 1 or 2A are referenced by the same numerals as in those figures, while structures which have been modified from structures found in FIG. 2A are indicated by an addition of a prime to indicate a different embodiment.

In FIG. 2B, conductors 11 and 13 are lengthened in order to permit transformers 17 and 19 to be located at a distance L/4 from transformer 15. Subsidiary stations are located at sites **14*b* and 14*c* distant from the main proximity effect heat-tracing circuit station which is designated as 14*a*** to indicate a distinct location.

Thus, in an existing proximity effect heat-tracing system the proximity effect heat-tracing circuit voltage may be reduced by one-half, while maintaining the same heat input to the same length of pipeline from the same main proximity effect heat-tracing station by installing two 2:1 step-down transformers 17 and 19 at each of two subsidiary proximity effect heat-tracing stations (one on each single-phase secondary of the Scott T transformer bank within main station 15). These reduced-voltage circuits may be carried on the same poles as the transmission line 10 to new remote feed points 20 and 22. At each new remote feed point, proximity effect heat-tracing circuit extends on the pipeline in the instruction for a distance L/4 which represents one-half the length of the original proximity effect heat-tracing circuit (at one-half of the original voltage).

Alternatively, step-down transformers 17 and 19 may be located near the remote feed points, as shown in FIG. 2B. By transmitting the proximity effect heat-tracing circuit power at a higher voltage before stepping down in transformers 17 and 19, smaller conductors may be used and transmission power losses may be reduced.

Figure 3:
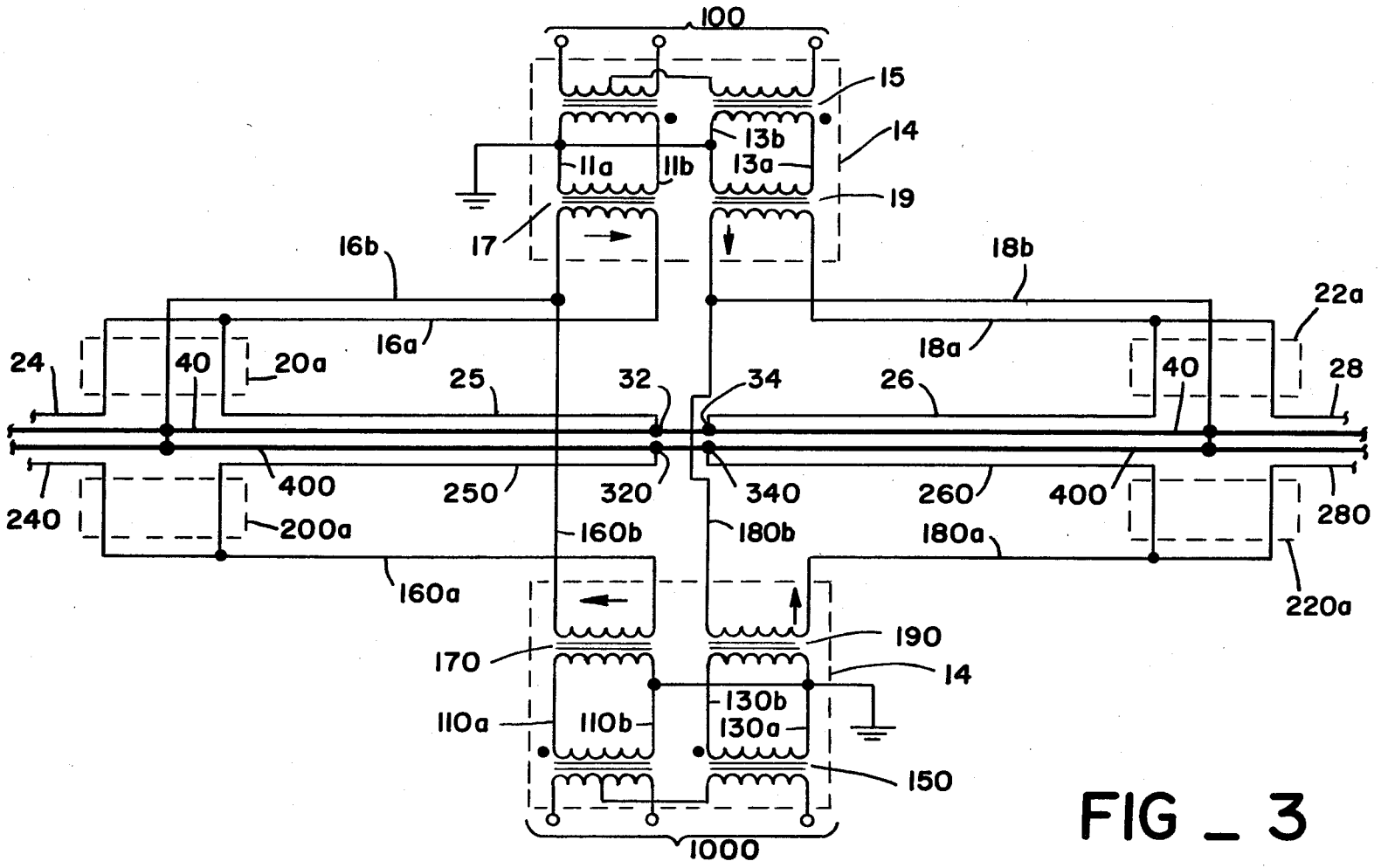
FIG. 3 is a fourth embodiment according to the present invention.

A fourth embodiment of the present invention is depicted in FIG. 3 wherein structures which are also found in FIG. 2A are referenced by the same numerals used in the reference numerals in FIG. 2A. Structures which appear in FIG. 1 in a different form are referenced by the same numerals as in FIG. 1 but with the addition of a letter to indicate a different embodiment.

In FIG. 3, main proximity effect heat-tracing station 15 is shown in greater detail than it is shown in FIG. 2A. Three terminals 100 of a Scott T transformer 15 are provided for connection to transmission line 10. Conductors 11 and 13 are shown as a conductor 11 connecting a first end of a secondary winding of transformer 15 with a first end of a primary of transformer 17 and conductor **11*b* which connects a second end of a first primary of transformer 17 with a second end of the first secondary of transformer 15 and with ground. Conductor 13*b* connects a first end of a second secondary of transformer 15 with a first end of a primary of transformer 19, while a conductor 13*a* connects a second end of transformer 19 with a second end of the second secondary of transformer 15** and with ground.

A conductor **16*a* connects a first end of a secondary of transformer 17 with feed point 20*a* while a conductor 16*b* connects a second end of the secondary of transformer 17 with heat tube 40 and with heat tube 400. A conductor 18*a* connects a first end of transformer 19 with feed point 22*a* while a conductor 18*b* connects a second end of transformer 19 with heat tube 40 and with heat tube 400**.

FIG. 3 also depicts a second proximity effect heat-tracing power supply system in which all elements corresponding to those found in the first system are indicated by the same numerals followed by a "0". Conductor **160*b* of the second system is connected to conductor 16*b* of the first system, and conductor 180*b* of the second system is connected to conductor 18*b* of the first system. As indicated by broken lines at the right and left margins of FIG. 3, both proximity effect heat-tracing systems have a greater horizontal extent than is depicted in FIG. 3. Nevertheless, FIG. 3** illustrates a representative portion of the two systems.

As shown in FIG. 3, if two proximity effect heat-tracing systems are installed on a pipeline, either for redundancy or to provide more heat that can be provided by a single proximity effect heat-tracing system, two Scott T Transformer banks may be installed at a single proximity effect heat-tracing location 14. The power for each of the two separate proximity effect heat-tracing systems may be carried by three conductors: two "hot" conductors, one for each proximity effect heat-tracing circuit; and a common neutral conductor connected to the heat tube 40 at the remote feed point. Transformer banks 15 and 150 are connected so that the secondary voltages of bank 150 are 180° electrically out of phase with the secondary voltages of bank 15. Thus, neutral conductors **16*b* and 18*b* will conduct no current when both systems are energized. Accordingly, conductors 16*b* and 18*b* may be sized to carry the same current as conductors 16*a*, 160*a*, 18*a* and 180*a*** because the neutral conductors will carry the same current as the "hot" conductors when only one system is energized as indicated.

Figure 4:
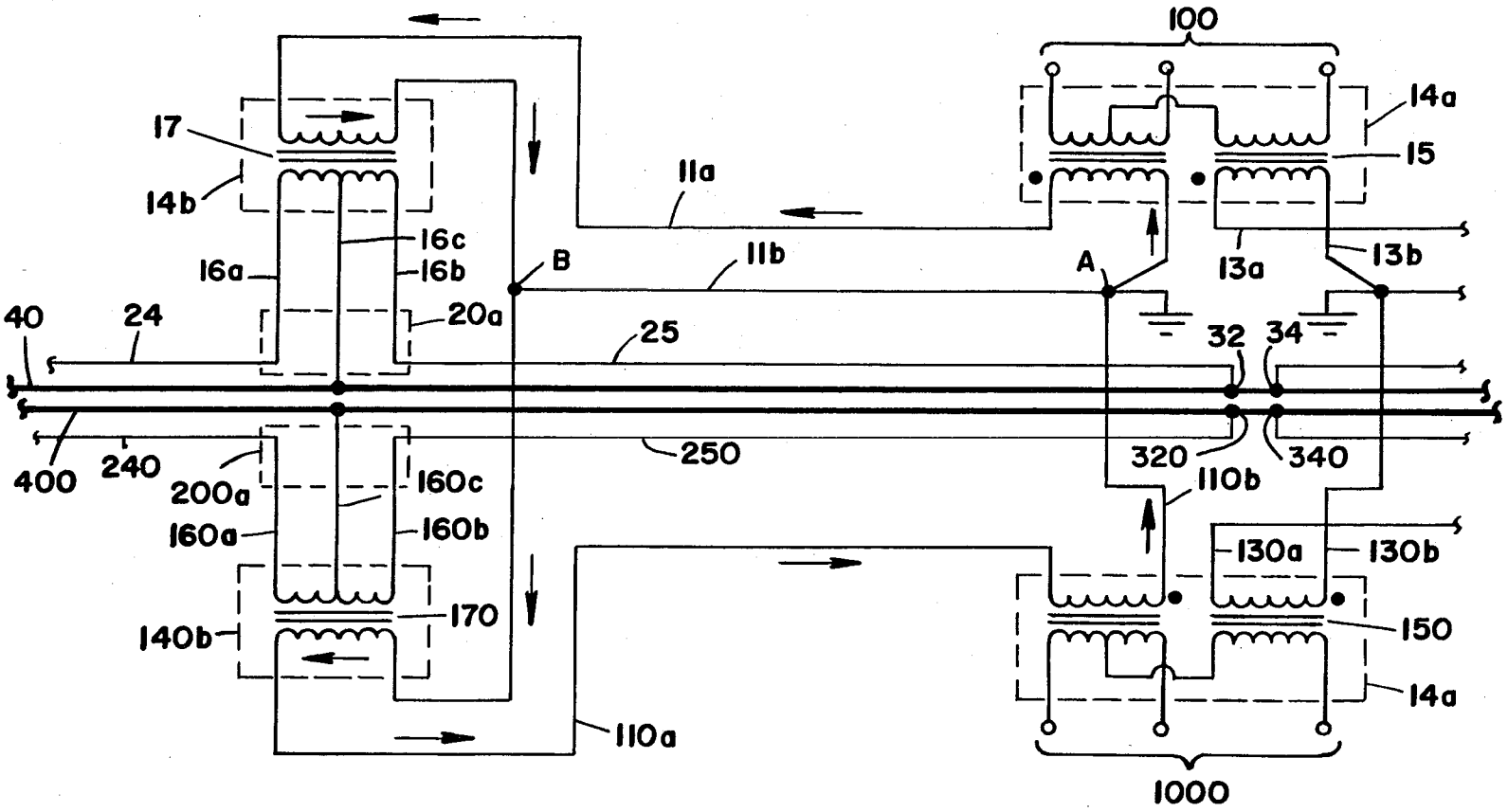
FIG. 4 is a fifth embodiment according to the present invention.

FIG. 4 illustrates a fifth embodiment according to the present invention in which elements common to FIG. 4 and FIG. 2B are identified by the same reference numerals in both Figures. Elements which appear in FIG. 2 or FIG. 3 and FIG. 4 but which are modified in FIG. 4 are indicated by the addition of a letter or a prime, respectively. FIG. 4 shows a partial view of a proximity effect heat-tracing system having two remote feed points wherein the structures are truncated as indicated by the broken lines at the left and right margins. Two proxiity effect feeding systems are shown, one for each of two proximity effect pipeline tracing circuits. Only a representative remote feed point is shown for each system. Elements within the second heat-tracing system are identified by the same numerals as their structural and functional counterparts in the first heat-tracing system with the addition of a "0" at the end of the numeral.

Primary windings of transformer 15 are connected to 3-phase transmission line 10 by way of terminals 100. The first end of a first secondary of transformer 15 is connected to conductor 11*a* which is in turn connected to the first end of the primary of transformer 17. A second end of the first secondary of transformer 15 is connected to ground and to a conductor 11*b* which is in turn connected to a second end of the primary of transformer 17.

The first end of secondary winding of transformer 17 is connected to a conductor 16*a* while a second end of secondary winding is connected to a conductor 16*b*. Conductor 16*b* is in turn connected to insulated conductor 25. A center tap of the secondary of transformer 17 is connected by way of a conductor 16*c* to heat tube 40. A feed point 20*a* constitutes the location at which conductor 16*a* connects with insulated conductor 24, 16*b* connects with insulated conductor 25, and 16*c* connects with heat tube 40.

As indicated by a dot at an end of each secondary winding of each Scott T transformer, secondary voltages of second Scott T transformer bank 150 are 180° electrically out of phase with the voltages of first Scott T transformer bank 15. Thus, common neutral conductor 11*b* carries no current between points A and B when both systems are energized. Accordingly, common neutral conductor 11*b* between points A and B may be sized to carry the same current as conductors 11*a* and 110*a*.

In the embodiment of FIG. 4, each of transformers 17 and 170 have a center-tapped secondary. Proximity effect heat-tracing circuits in either direction from feed points 20' and 200' are connected between one end of a secondary and a center tap. For example, a proximity effect heat-tracing circuit containing insulated conductor 25 and heat tube 40 is connected between the second end of transformer 17 and the center tap of transformer 17 which is connected to conductor 16*c*. In this configuration, no current flows in neutral conductors 16*c* and 160*c* between the center taps of transformers 17 and 170, respectively, and conductors 40 and 400, respectively, under normal conditions, that is, when the proximity effect heat-tracing circuits connected to each secondary balance with the other.

In the embodiment of FIG. 4, a transformer step-down ratio can be selected to compensate for a voltage drop between a Scott T transformer at a main proximity effect heat-tracing station and a step-down transformer.

While the present invention has been described in terms of a preferred embodiment, further modifications and improvements will occur to those skilled in the art. For example, the present invention is not limited to two subsidiary proximity effect heat-tracing energy feed points for each main transformer but may be extended to more than two remote feed points on either side of each main transformer. Because of the voltage drop in power lines to remote feed points, slightly less voltage is available at each feed point successively more remote from the main proximity effect heat-tracing station. In order to maintain the same current in each proximity effect heat-tracing circuit, the length of proximity effect heat-tracing circuit set at more remote feed points may be reduced in proportion to the reduction in voltage. Alternatively, the turns "ratios of step-down transformers" may be selected to compensate for the reduction in voltage. In addition, although two subsidiary stations have been discussed for each main station herein, the number of subsidiary stations to be used with each main station is a matter of design choice. Furthermore, although a step-down ratio of 2:1 has been specified herein for subsidiary transformers, other step-down ratios may be employed as are convenient for a particular application.

I desire to be understood, therefore, that this invention is not limited to the particular form shown and that I intend in the appended claims to cover all such equivalent variations which come within the scope of the invention as claimed.

What is claimed is:

1. Apparatus for supplying alternating electrical current from a common power source to a plurality of proximity effect heat-tracing circuits, each circuit heating one of a plurality of generally serially connected pipeline segments, comprising:

a main power station comprising a main step-down transformer having at least one primary winding coupled to the alternating current power source and at least one secondary winding for supplying power to a plurality of heat-tracing circuits;

a plurality of subsidiary stations spaced apart from each other and from said main station at selected distances along said pipeline, each of said subsidiary stations being coupled external to said pipeline to said secondary winding of said main station transformer as a common current source, and each of said subsidiary stations being coupled to at least a pair of said plurality of proximity effect heat-tracing circuits so that one of said pair of circuits extends along said pipeline away from said main station and the other of said pair of circuits extends along said pipeline toward said main stations whereby said main power station separately supplies at least two of the four proximity effect circuits with alternating current at substantially reduced voltage or current, or both to heat the same length of said pipeline.

2. The apparatus as recited in claim 1 wherein said main step-down transformer comprises a plurality of secondary windings and each of said plurality of subsidiary stations includes a subsidiary step-down transformer having its primary coupled to one of said secondary windings of said main transformer as the power supply for each of said subsidiary step-down transformers, the secondary winding of each of said subsidiary step-down transformers being coupled as a common current source for one pair of said heat-tracing circuits.

3. The apparatus as recited in claim 2 wherein at least one of the secondary windings of said subsidiary step-down transformers is center-trapped.

4. The apparatus as recited in claim 2 wherein said main power station includes another step-down transformer having its primary winding connected to the secondary winding of said main step-down transformer, and its secondary winding is connected to at least one primary winding from among said plurality of subsidiary step-down transformers and both said main power station transformers are at a common location.

5. The apparatus as recited in claim 2 wherein said main station includes at least one additional step-down transformer located along said pipeline at a different location.

6. The apparatus as recited in claim 2 further comprising:

a second main step-down transformer having a primary winding coupled to said secondary winding of the first said main step-down transformer as the common power source for said heat-tracing circuits and having a plurality of secondary windings;

a second plurality of subsidiary step-down transformers, each of said second plurality of subsidiary transformers having a primary winding coupled to one of said secondary windings of said second main step-down transformer, and each having a secondary winding coupled as a common current source to at least one of said proximity effect heat-tracing circuits and each being connected 180° out of phase with a counterpart secondary winding from among said first plurality of subsidiary step-down transformers; and a common neutral conductor coupled to each secondary winding of said first plurality of subsidiary step-down transformers and to each secondary winding of said second plurality of subsidiary transformers.

7. The apparatus as recited in claim 6 wherein the secondary winding of at least one from among said subsidiary step-down transformers is center-tapped.

8. The apparatus as recited in claim 6 wherein one of said main transformers and at least one of said plurality of subsidiary step-down transformers are located at a common location.

9. The apparatus as recited in claim 6 wherein one of said main step-down transformer is at a location different from a location of at least one of said plurality of subsidiary step-down transformers.

10. The apparatus as recited in claim 1 wherein said main step-down transformer is a 3-phase to 2-phase transformer.

11. The apparatus as recited in claim 1 wherein the output of the secondary winding of said main step-down transformer is a single-phase.

12. A method for supplying alternating electrical current power from a common power source to a plurality of proximity effect, heat-tracing circuits, each circuit forming an independent linear heat source for one of a plurality of serially connected segments of a pipeline, comprising the steps of:

coupling the input terminals of a primary winding of a first main step-down transformers in a first main station to an alternating current power source;

coupling the output terminals of a plurality of secondary windings of said first main step-down transformer in parallel to each of a plurality of separate subsidiary stations spaced apart from each other and laterally to each side of said main station along said pipeline as a common current source, said coupling being through lines externals to said pipeline segments; and coupling each of the subsidiary stations input terminals to at least two of said plurality of proximity effect heat-tracing circuits so that one of said two circuits extends away from said main station and the other of said two circuits extends toward said main station along said pipeline.

13. The method as recited in claim 12 wherein said step of coupling the output terminals of a plurality of secondary windings of said first main transformer to said plurality of separate subsidiary stations comprises the steps of:

coupling each of the plurality of secondary step-down windings of the first main transformer to a primary winding of one of a first plurality of subsidiary step-down transformers, the secondary winding of each of said first plurality of subsidiary step-down transformers being coupled as a common current source for each of said two proximity effect heat-tracing circuits.

14. The method as recited in claim 13 further comprising the step of compensating for a voltage drop from said first main transformer secondary to at least one subsidiary step-down transformer primary by adjusting the turns ratio of the primary winding to the secondary winding of said subsidiary step-down transformer.

15. The method as recited in claim 13 further comprising the steps of:

coupling a second main step-down transformer to the power source;

coupling each of a plurality of secondary windings of said second main step-down transformer to a primary winding of one of a second plurality of subsidiary step-down transformers, the secondary winding of each of said second subsidiary step-down transformers being paired in a common current source relationship with the secondary winding of one of said first plurality of said subsidiary step-down transformers and each winding of said pair being coupled 180° out of phase; and coupling a common neutral conductor to each of said secondary windings of said first plurality of subsidiary step-down transformers and said second plurality of subsidiary step-down transformers.

16. The method as recited in claim 13 further comprising the step of compensating for a voltage drop from at least one of said transformers secondaries main transformer secondaries to at least one primary of a subsidiary step-down transformer by adjusting the turns ratio between said primary and said secondary windings of at least one of said subsidiary transformers.

17. A method for reducing the amount of voltage applied to an in-place proximity effect heat-tracing circuit for heating an existing pipeline, said circuit including a main transformer including a primary winding coupled to a single power source and at least a first proximity effect heat-tracing circuit coupled to the secondary winding of said main transformer comprising the steps of: coupling the output of said secondary winding to at least another proximity effect heat-tracing circuit in parallel with said first circuit and in a common source relationship with each other to replace said first proximity effect heat-tracing circuit;

coupling the center points of each of said first and second proximity effect heat-tracing circuits in series with the secondary winding of said main transformer; and coupling both the outer ends of both of said first and second proximity effect heat-tracing circuits to said pipeline as a common ground.

* * * * *